United States Patent [19]

Primrose

[11] Patent Number: 4,601,612

[45] Date of Patent: Jul. 22, 1986

[54] SANDJET ROTATING NOZZLE

[75] Inventor: Matthew J. Primrose, Sarawak, Malaysia

[73] Assignee: Shell Oil Company, Houston, Tex.

[21] Appl. No.: 694,737

[22] Filed: Jan. 25, 1985

[51] Int. Cl.[4] ..... E02D 7/24

[52] U.S. Cl. ..... 405/226; 405/269; 405/195

[58] Field of Search ..... 405/73, 74, 195, 226, 405/248, 225, 269, 258, 266, 267, 222, 223

[56] References Cited

U.S. PATENT DOCUMENTS

| | | | |
|---|---|---|---|
| 1,899,346 | 2/1933 | Miller | 405/222 |
| 2,191,845 | 2/1940 | Bretting | 405/258 |
| 3,577,738 | 5/1971 | Havnø | 405/258 |
| 3,786,639 | 1/1974 | Pineno et al. | 405/267 |
| 3,965,687 | 6/1976 | Shaw | 405/226 |

OTHER PUBLICATIONS

T. Yahiro and H. Yoshida, *Induction Grouting Method Utilizing High Speed Water Jet,* Aug. 1973.

*Primary Examiner*—Cornelius J. Husar
*Assistant Examiner*—Kristina I. Hall

[57] ABSTRACT

A method of filling voids underneath the lower surface of a structure placed upon the ocean floor, using a sandjet stinger conduit inserted through the structure to carry a water and sand suspension to the base of the structure.

7 Claims, 2 Drawing Figures

SANDJET ROTATING NOZZLE

BACKGROUND OF THE INVENTION

1. Field of the Invention

The invention relates to a method of laying foundation material beneath a gravity foundation marine structure placed upon the ocean floor.

2. Description of the Prior Art

Two general methods of laying foundation material under a structure have already been practiced. In both methods, water is used as a carrier fluid to transport sand, the foundation material, to voids beneath the structure. When the suspension consisting of the water and sand reaches the void, the resultant velocity decrease of the suspension causes the sand particles to fall from the flowstream and deposit in the void. The water must leave, or be removed from, the void area to allow more sand and water suspension to reach the void.

In the first known method, the water is drawn from the void by a return pipe. In the second known method, the water dissipates naturally away from the suspension injection point, taking the path of least resistance in exiting the void area.

More specifically, the first method utilizes a suspension supply pipe which extends from each injection point to remote portions of the void. The supply pipe is accompanied by a water return pipe which removes the sand depleted water from the void. The pipes may be moved about within the void to eventually fill all portions of the void. This method requires the installation of an extensive piping header system to supply water to and from the void from each injection point.

In a patentable variation of the above first method in the second method, a single supply of suspension is directed from each supply point, with no return piping to remove surplus water from the void. In U.S. Pat. No. 3,683,632, filed July 28, 1970, Ser. No. 58,771, issued Aug. 15, 1972 to Romke van der Veen et al., this method is used to form a crater around the supply place, the crater subsequently being filled up with foundation material. In operation, suspension is supplied to the crater and the sand initially deposits around the rim of the crater. Additional suspension supplied to the crater causes a portion of the originally deposited rim to collapse outward, which causes a channel to form over the upper edge of the rim. Additional suspension flows through this channel, which eventually seals off from accumulated sand. With this method, the edge of the crater grows gradually outward so as to form a continuous layer of foundation material.

But the proper operation of this method depends upon the free dissipation of water away from the suspension injection point. In other words, this process cannot be used to fill an isolated void. Since there is no path for the water which has carried the sand to the void to leave the void, no further sand carrying water can be supplied to the void. Another disadvantage of this second method, as disclosed in Pat. No. '632, is the required installation of an extensive piping header system to supply sand laden water to each supply point.

In consideration of the size of a typical structure to be placed upon the ocean floor, the magnitude of the required piping system can readily be visualized. For example, a gravity foundation structure for installation in arctic waters may have a lower surface diameter of 550 feet that contacts the ocean floor. Full scale tests have shown that sand can be deposited within a radius of approximately 50' from a single sand and water suspension outlet. The gravity foundation structure would therefore require from 160 to 200 separately piped outlets installed through its lower surface, with associated isolation valves, bulkhead penetrations, and flow directing manifolds. Such a system may only be used several times during the life of the structure, and would require continuous maintenance.

A method needs to be developed that eliminates the disadvantages inherent with the installation and operation of an extensive piping system required for these infrequent jetting operations. This new method should not, however, sacrifice any of the sandjetting capabilities of the two current methods.

SUMMARY OF THE INVENTION

In a preferred embodiment of the present invention, the lower end of a sandjet stinger is selectively positioned below the lower surface of the structure to fill isolated or non-isolated voids located beneath the structure's lower surface.

More specifically, the sandjet stinger is passed down through substantially vertical sandjet stinger throughbores defined through the structure until the lower end of the stinger projects below the lower surface of the structure. The sandjet stinger acts as a flow conduit to carry the water and sand suspension below the structure. By appropriate sizing, the annulus defined between the walls of the throughbore and the stinger may be used as an outlet conduit for water which has deposited sand below the structure.

A mechanical package located at the upper end of the stinger performs several functions. It supports the sandjet stinger at a predetermined elevation such that the outlet nozzle is held at the correct elevation below the lower surface of the structure. The package houses a motor which rotates the sandjet stinger's lower end, causing relatively even distribution of the sand. The package also supports any inlet or outlet fittings or any required instrumentation. A packer element is used to seal the stinger upper elements from any annulus return flow thereby directing the return flow to metering and pumping equipment as necessary, and also secures the stinger within the stinger throughbore.

Even more specifically, the present invention comprises a method of completing a foundation beneath a gravity foundation marine structure located in a body of water having an ocean floor, said structure having a substantially flat extensive lower surface and a plurality of sandjet stinger throughbores defined through said lower surface of said structure, said method comprising; placing said structure upon the ocean floor with the lower surface of said structure in contact with portions of the ocean floor; lowering a sandjet stinger through at least one of said stinger throughbores, said sandjet stinger having an upper and lower end and a longitudinal axis; forming a suspension of particulate material such as water as a carrier fluid and sand as a particulate material carried by said water, at a location above the surface of the water; flowing such suspension downwardly through said sandjet stinger and into a void between said structure lower surface and said ocean floor; allowing a substantial portion of the particulate material to settle out of the suspension and deposit on said ocean floor; allowing a substantial portion of the carrier fluid to exit upwardly from said void through at least one of said sandjet stinger throughbores; continuing the flowing of suspension, depositing of particulate material, and exiting of carrier fluid; and building an aggregation of deposited material reaching from said ocean floor to said lower surface of said gravity foundation marine structure.

The invention eliminates a large number of fixed sandjetting nozzles.

A further advantage of the present invention is that virtually all parts of the revised system which could be subjected to wear or erosion by the sand are contained in the sandjet stinger, which is routinely removed after use in each sandjet throughbore and is therefore easily repaired.

A further advantage is that all conduits carrying the sand and water suspension are free from sharp bends and possible stagnation points, therefore the system should be relatively free from sand plugging.

The invention has the object of providing a structure placed upon the ocean floor with an economical sandjetting system to be used to fill voids beneath the structure.

These and other features, objects, and advantages of the present invention will become apparent from the following detailed description, wherein reference is made to the Figures in the accompanying drawing.

DESCRIPTION OF THE PREFERRED EMBODIMENT

Figure 1:
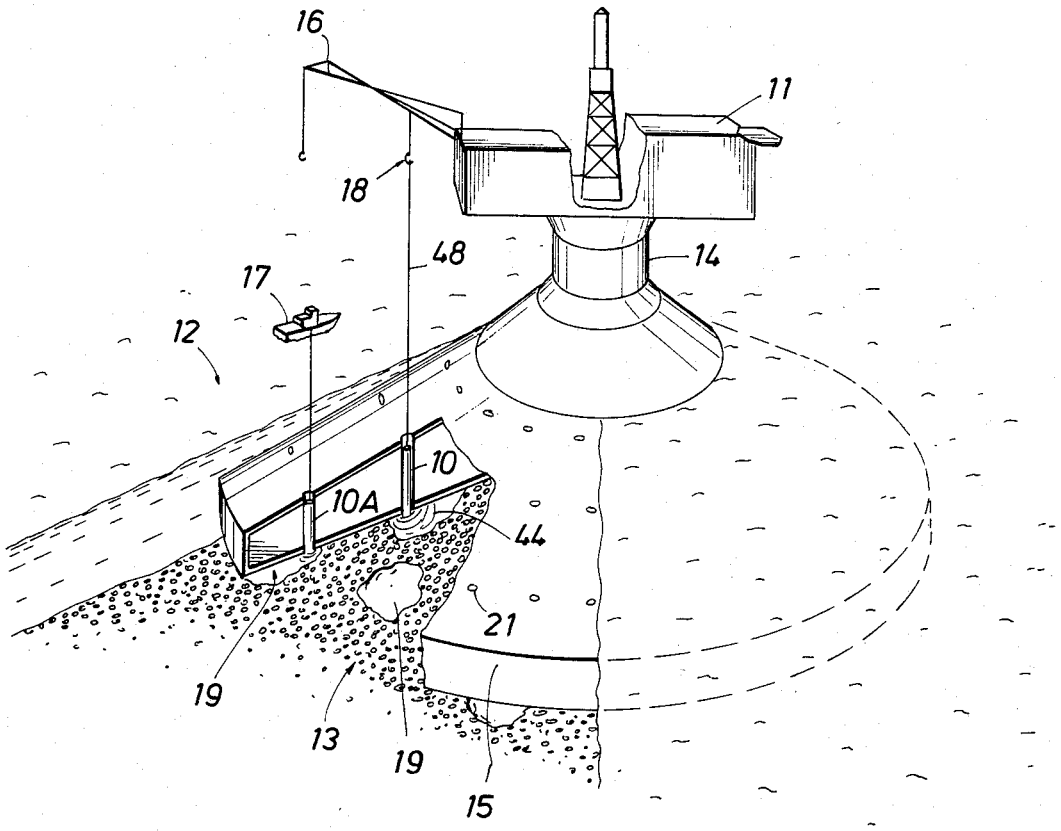
FIG. 1 is an isometric view in partial cross section of a gravity foundation structure placed upon the ocean floor.

As shown in FIG. 1, a gravity foundation marine structure 14 is shown placed upon the ocean floor 13 of a body of water 12. The base of the marine structure 15 has contacted a substantial portion of the ocean floor 13, although voids 19 approximately 4' deep usually still exist between the lower surface of the base 15 and the ocean floor 13 after the installation of this marine structure 14 in, for example, arctic waters. A platform 11 supports a platform crane 16 with an associated hook attachment 18.

Sandjet stinger throughbores 21 are shown defined substantially vertically through the base of the marine structure 14. It is recognized that these throughbores 21 need not be vertical in nature but may be constructed in a fashion to favor the geometric orientation of the base 15. A sandjet stinger 10, the object of the present invention, is shown suspended from the hook attachment 18 of the platform crane 16 by means of a cable 48 and is also shown suspended from a support vessel 17 downwardly through the base 15 of the marine structure. Sand 44 is shown being pumped through the sandjet stinger 10 down to the voids 19 defined below the lower surface of the base 15. By filling the voids 19, the structure 14 will become evenly supported about its lower surface, thereby reducing the stresses associated with the unsupported portions of the lower surface of the base 15, reducing the likelihood of structural failure above the voids 19, and improving the sliding resistance of the structure through increased contact with the ocean floor 13.

Although the sandjet stingers 10 are shown filling voids 19 below the gravity foundation marine structure 14, it is also well recognized that the method of operation of sandjetting set forth in this description can also be applied to any other marine structure that is to be placed upon the bottom of a body of water 12. Underwater tunnel installations may, for example, be grouted with sand 44 in the manner set forth in this disclosure.

Figure 2:
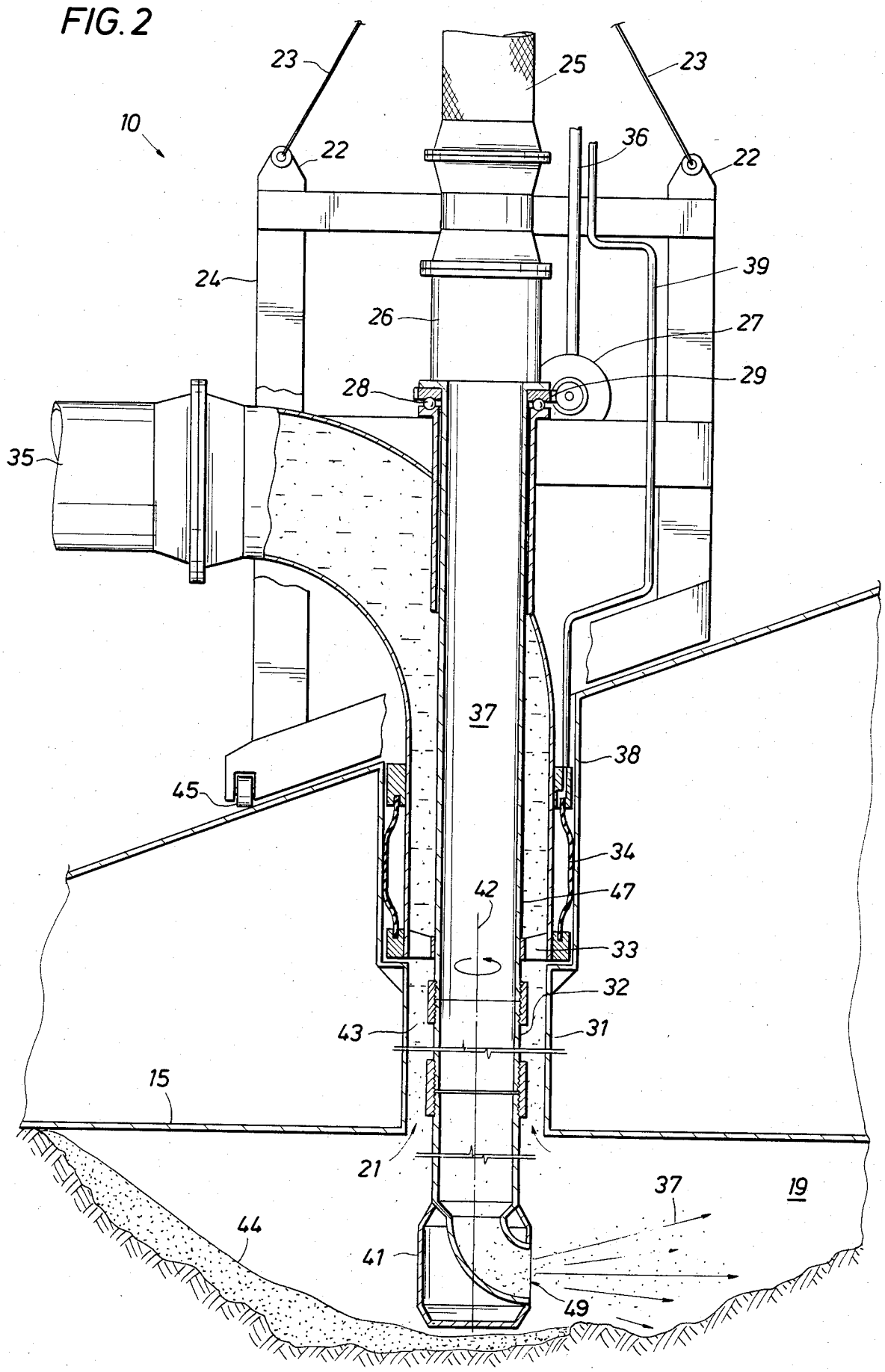
FIG. 2 is a schematic representation of the sandjet stinger inserted through the marine structure.

As shown in more detail in FIG. 2, a sandjet stinger 10 extends downwardly through the base of the marine structure 15, the lower end of the stinger 10 projecting downward below the lower surface of the base 15. The sandjet stinger 10 has been inserted and lowered down through the sandjet stinger throughbore 21. A packer element 34 placed near the upper portion of the stinger 10 is activated to retain the stinger 10 within the stinger throughbore 21 and also to provide a hydraulic seal to prevent the water and sand mixture 43 from flowing to the top surface of the marine structure 15. In this manner, the water and sand mixture 43 is directed to the outlet piping 35 which discharges to a density meter (not shown) and/or a pump means (not shown). A guide spider 33 assists in aligning the sandjet stinger 10 as it passes downwardly through the enlarged sandjet stinger throughbore 38. The guide spider 33, due to its contact with the lower portion of the enlarged sandjet stinger throughbore 38, maintains the lower end of the sandjet stinger 10 at a predetermined distance below the base of the marine structure 15. The outer elements of the sandjet stinger throughbore 21 are defined by the base bulkhead 31 which forms a watertight boundary between the sandjet stinger throughbore 21 and the internal portion of the base structure 15. A stinger extension section 32 may be incorporated to increase the overall length of the stinger 10 for insertion in throughbores 21 having various overall lengths.

A pneumatic, electric, or hydraulic drive motor 27 is shown mounted on the frame 24 located at the upper end of the sandjet stinger 10. The motor 27 engages gear teeth 29 cut in the upper section of the stinger rotating section 47 in order to rotate the section 47 about its longitudinal axis 42. A thrust bearing 28 allows the rotary movement of the stinger rotating section 47 about its axis 42 as well as a fluid swivel 26 installed below an inlet hose 25 which carries a sand and water suspension 37 from mixers (not shown) located on the vessel 17 or the platform 11.

Depending from the vessel 17 or the platform 11 are a sling 23 for supporting the stinger frame 24 by attachment to lifting eyes 22, a power conduit 36 for supplying power to the motor 27, and an air hose 39 for inflation of the packer element 34. Due to the sloping angle of the upper surface of the marine structure 15, a roller 45 is shown installed on the lower elements of the frame 24 to assist in swiveling the frame 24 downward into correct alignment with the upper elements of the base 15.

In operation, the structure 14 is placed upon the ocean floor 13 with the lower surface of the base 15 in contact with portions of the ocean floor 13. A sandjet stinger assembly 10 is then lowered through one of the stinger throughbores 21, though it is well recognized that not only one stinger 10 need be used at one time. In other words, a plurality of sandjet stingers 10 may be used simultaneously about the structure base 15 in order to speedily fill the voids 19 existing beneath the structure 14. A suspension of particulate material 37 such as water used as a carrier fluid, and sand 44 used as the particulate material carried by the water, is then prepared at a location above the surface of the water 12. The sand and water suspension 37 is then flowed downwardly through the sandjet stinger 10 and into a void 19 existing between the base of the marine structure 15 and the ocean floor 13. A substantial portion of the sand 44 is then allowed to settle out of the suspension 37 and deposit on the ocean floor 13. Rotation of the stinger rotating section 47 assists in distributing evenly the sand 44 about the void space 19. A protective shield 41 placed about the lower end of the stinger rotating section 47 prevents damage to the suspension outlet 49.

A substantial portion of a water and sand mixture 43 is then allowed to exit upwardly from said void 19 through at least one of said sandjet stinger throughbores 21. If the void 19 is isolated, by not being connected to another void 19 that may be reached through another sandjet stinger throughbore 21, the water and sand mixture 43 will return upward through the annulus defined between the sandjet stinger 10 and the walls of the stinger throughbore 21. If on the other hand, the void 19 to be filled can be reached by two or more sandjet throughbores 21, then flow may be initiated through one stinger 10 and the flow subsequently removed from the void 19 through another sandjet stinger throughbore 21. In this fashion, sand 44 will not be localized entirely beneath one sandjet throughbore 21, but instead will flow from one sandjet throughbore 21 to another throughbore 21 in order to completely fill the void 19 existing between two or more sandjet throughbores 21. In any event, the flowing of the suspension 37, the depositing of the sand 44, and the exiting of the water and sand mixture 43 from the void 19 will continue until an aggregation of sand 44 is built below the bottom of the structure 15 reaching from the ocean floor 13 to the lower surface of the marine structure 14.

During the flowing of the suspension 37 down to the void 19, the concentration of the sand in the water will be monitored by use of a densitometer (not shown) placed on the inlet to the void 19 and also an additional densitometer placed on the outlet of the void 19. By monitoring the amount of sand 44 entering and leaving the void 19, the flow of said sand and water suspension 37 into the void 19 can be terminated when the concentration of the sand 44 flowing into the void 19 substantially equals the concentration of the sand 44 carried by the water flowing from the void 19.

The preferred embodiment also includes a pump means (not shown) in communication with the water and sand suspension 43 exiting the void 19. Energization of the pump means (not shown) increases the flow of water and sand 43 flowing from the void 19, which decreases the hydrostatic pressure applied to the lower surface of the structure 14 by the suspension 37 flowing into the void 19. This prevents an excessive upward force to be applied to the lower base of the structure 15, which would cause a subsequent upturning moment and possible tilting of the entire structure 14. The pump means to remove the water and sand suspension 43 to reduce the hydrostatic pressure can be any means well known to the art such as an electrically driven pump mounted upon the platform 11. Conversely, the pump means may consist of an air lifting mechanism placed within the annulus existing between the sandjet stinger 10 and the structure 15. In other words, bubbling air into the column of suspension 43 leaving the void 19 will cause the column to have less hydrostatic head than the surrounding suspension 37 being supplied to the void 19. In this manner, the water and sand suspension 43 will be pumped from the void 19, thereby decreasing the hydrostatic pressure existing within the void spaces 19.

Due to the reusable nature of the sandjet stingers 10, it can be seen that once a stinger 10 has been used to fill one void 19, it can be retracted from that stinger throughbore 21 and inserted downwardly through another sandjet stinger throughbore 21 in order to fill another void area 19.

Many other variations and modifications may be made in the apparatus and techniques hereinbefore described by those having experience in this technology without departing from the concept of the present invention. Accordingly, it should be clearly understood that the apparatus and methods depicted in the accompanying drawings and referred to in the foregoing description are illustrative only, and are not intended as limitations on the scope of the invention.

I claim as my invention:

1. A method of completing a foundation beneath a gravity foundation marine structure located in a body of water having an ocean floor, said structure having a substantially flat extensive lower surface and a plurality of sandjet stinger throughbores defined through said lower surface of said structure, said method comprising, placing said structure upon the ocean floor with the lower surface of said structure in contact with portions of the ocean floor, lowering a sandjet stinger through at least one of said stinger throughbores, said sandjet stinger having an upper and lower end and a longitudinal axis, forming a suspension of particulate material such as water as a carrier fluid and sand as a particulate material carried by said water, at a location above the surface of the water, flowing such suspension downwardly through said sandjet stinger and into a void between said structure lower surface and said ocean floor, allowing a substantial portion of the particulate material to settle out of the suspension and deposit on said ocean floor, allowing a substantial portion of the carrier fluid to exit upwardly from said void through at least one of said sandjet stinger throughbores, continuing the flowing of suspension, depositing of particulate material, and exiting of carrier fluid, and building an aggregation of deposited material reaching from said ocean floor to said lower surface of said gravity foundation marine structure.

2. The method as claimed in claim 1 further including supporting said sandjet stinger so as to position said lower end of said sandjet stinger at a predetermined distance below the lower surface of said structure.

3. The method as claimed in claim 1 including the step of:

rotating said sandjet stinger lower end about said longitudinal axis of said sandjet stinger during the flowing of the suspension.

4. The method as claimed in claim 1 including the steps of:

monitoring the concentration of said particulate material in said suspension flowing downwardly to said void, monitoring the concentration of said particulate material in said suspension flowing upwardly from said void, and terminating the flow of said suspension when the concentration of particulate material flowing into the void substantially equals the concentration of particulate material flowing from the void.

5. The method as claimed in claim 4 including the steps of:

providing a pump means in communication with the particulate material suspension flowing from the void, and energizing said pump means to decrease the hydrostatic pressure applied to the lower surface of said structure by the suspension flowing into said void.

6. The method of claim 1 wherein the step of allowing the carrier fluid to exit upwardly from said void through at least one of said sandjet stinger throughbores is accomplished by flowing the particulate material suspension upwardly from said void between said sandjet stinger and said structure.

7. The method of claim 1 including, subsequent to the step of lowering a sandjet stinger through at least one of said stinger throughbores; the steps of;

retracting said sandjet stinger from one of said stinger throughbores; and inserting said sandjet stinger into another of said stinger throughbores.

* * * * *